United States Patent [19]

Stellwagen et al.

[11] 3,951,014

[45] Apr. 20, 1976

[54] MAGNETIC RESET TOOL

[75] Inventors: Frank W. Stellwagen, Clearwater, Fla.; Thomas G. Bain, Trumbull, Conn.

[73] Assignee: General Time Corporation, Thomaston, Conn.

[22] Filed: Nov. 21, 1974

[21] Appl. No.: 525,816

[52] U.S. Cl. ..... 81/3 R; 7/1 Q

[51] Int. Cl.[2] ..... B25B 9/00

[58] Field of Search ..... 81/3 R; 335/285, 306; 7/1 Q

[56] References Cited

UNITED STATES PATENTS

| | | | |
|---|---|---|---|
| 512,381 | 1/1894 | Keyes | 7/1 Q |
| 541,038 | 6/1895 | Clark | 7/1 Q |
| 1,127,838 | 2/1915 | Willers | 7/1 Q |
| 1,141,073 | 5/1915 | Parks | 7/1 Q |
| 3,425,055 | 1/1969 | Pihl et al. | 340/373 |

FOREIGN PATENTS OR APPLICATIONS

| | | | |
|---|---|---|---|
| 6,355 | 1891 | United Kingdom | 7/1 Q |

*Primary Examiner*—Al Lawrence Smith
*Assistant Examiner*—Roscoe V. Parker
*Attorney, Agent, or Firm*—Pennie & Edmonds

[57] ABSTRACT

A portable magnetic tool device adapted for adjusting the position of a movable magnetic member or the like. The tool device essentially comprises a portable support means, at least a first magnetic means connected to the portable support means having a first magnetic charge or field which enables selective adjusting of the position of the movable member, and shield means operatively connected to the portable support means and, at least, partially surrounding the first magnetic means for movement between shielding and non-shielding positions, such that whenever in the non-shielding position the first magnetic charge is able to appropriately adjust the position of the movable member.

6 Claims, 4 Drawing Figures

MAGNETIC RESET TOOL

BACKGROUND OF THE INVENTION

1. Field of the Invention

This invention is related to a portable tool and, more particularly, to a hand portable magnetic reset tool, particularly adapted for use in selectively resetting electromagnetic indicators or the like.

2. Description of the Prior Art

In industry, conventional binary magnetic indicators of the electromagnetic type provide for non-illuminated contrasting color displays. Such electromagnetic indicators find utility in a wide variety of installations. For example, aircraft and portable electronic equipment. Normally, they are preferred over the typical illuminated indicators, such as those using glow tubes or bulbs, especially wherein the ambient light conditions make it difficult to distinguish the display from the surrounding background.

Ordinarily, these prior art electromagnetic type indicators are characterized by a rotatably spherical magnetic indicator member that has discrete opposite magnetic poles, a latching magnet that serves to latch the indicator member in a position, and an energizing coil adjacent the latching magnet and spherical magnetic indicator member. Upon energization of such coil, a magnetic field will be created which causes the latching magnet and the spherical magnetic indicator to rotate to a reversed position. Resetting of the electromagnetic indicator, i.e., making the spherical indicator return to its original position may be accomplished by introducing an overriding magnetic field which is sufficient to unlatch and reposition the indicator member.

One prior art approach for resetting the electromagnetic indicators is accomplished by moving the electromagnetic core of such indicator into close proximity with a strong permanent resetting magnet that is located in line with the electromagnet so as to induce in the core thereof a magnetic field opposite to the field induced therein by the energizing coil. The resulting magnetic field is of sufficient strength to reverse the position of the indicator member. Such approach, however, has certain drawbacks in that it is necessary that the resetting magnet be isolated from the coil and its core until such time as the indicator is to be reset. This normally requires maintaining a relatively large gap or space between the electromagnet and the resetting magnet. The gap, however, results in relatively long, less compact, indicator housings. Moreover, the aforedescribed construction is somewhat expensive to manufacture and is somewhat more complicated in structure by virtue of the necessity to have a permanent magnet associated with each of the electromagnetic cores for the respective electromagnetic indicators.

Another prior art approach to reset conventional electromagnetic indicators is accomplished through an auxilliary permanent magnet which is movably mounted on a fixed panel adjacent the indicator and arranged to operatively cooperate with an extension that projects out of the indicator housing in the path of movement of the resetting permanent magnet. A shield device is provided for shielding the resetting magnet and holding it away from the core extension to which such projection is operatively connected. At such time it is desired to reset the indicator, the resetting permanent magnet is moved toward the core extension. As the gap between the resetting magnet and core extension is diminished, the resetting magnet induces in the electromagnetic core a magnetic field which overrides the magnetic latching and causes the spherical indicator member to rotate back to its original position. This latter approach, as with the preceding, results in certain shortcomings, foremost among which is the necessity to provide each electromagnetic indicator operatively connected to a panel with a permanent magnet as well as a core extension member which operatively cooperates between the electromagnetic core and the permanent magnet. It is obvious, therefore, that this particular form of construction is relatively complicated in its arrangement not to mention being somewhat expensive in its construction.

SUMMARY OF THE INVENTION

Accordingly, therefore, it is an object of the present invention to overcome the prior art shortcomings previously referred to in resetting conventional electromagnetic indicator devices by providing a portable hand-gripable, magnetic reset tool which is not only simple in construction, reliable in operation, but also obviates the necessity of requiring permanent resetting magnets being associated with each of the electromagnetic indicator devices.

Hereinafter briefly stated, the invention comprises a hand portable magnetic reset tool especially adapted for externally resetting electromagnetic indicator devices or the like located on a stationary structure. These indicators have a housing including a generally annular flange located adjacent a movable magnetic spherical indicator member which is movable within the housing and is subjected to opposite magnetic fields applied thereto by the electromagnetic indicator. The reset tool of the present invention embodies a generally elongated housing member, first and second permanent resetting magnets, and first and second biased generally elongated shield members. The generally elongated housing member is sized and constructed to enable it to be hand gripped and carried. The aforenoted first and second permanent resetting magnets are respectively operatively connected adjacent opposite ends of the housing member.

The present invention contemplates that the first resetting magnetic member have a north magnetic pole which faces generally away from the housing member. Such first magnetic member is designed to produce a first magnetic field which exceeds the magnetic field applied by the electromagnetic indicator on the movable magnetic spherical indicator member for purposes of overriding such latter magnetic field so as to repossess the movable spherical indicator member by virtue of magnetic repulsion. The second permanent resetting magnetic member is arranged such that its south magnetic pole faces generally away from the housing member. It too has a magnetic field which exceeds that of the magnetic field applied by the electromagnetic indicator device on the movable spherical indicator element. In such a manner, the magnetic field of the second magnetic member is sufficient to override an opposite magnetic field induced by the electromagnetic indicator on the indicator member so as to reposition it, and, in so doing, change the indication provided by such indicator member.

The first and second shield members are spring biased and have a generally elongated tubular configuration. Such shield members are arranged to slidably cooperate with respective opposite ends of the housing member and are movable between first or shielding positions and second or non-shielding positions for selectively magnetically shielding the first and second resetting magnets. Moreover, the shield members are arranged such that they substantially enclose the magnetic means even while in the second or so-called non-shielding position. This permits the shield members to prevent inadvertent magnetizing of other indicator members or the like. In addition, each of the first and second shield members have a recess provided at one end thereof which is adapted to receive the end flange of a conventional electromagnetic indicator housing for enabling the convenient positioning of the hand reset tool thereon. Consequently, the permanent resetting magnets may be selectively placed in close proximity to the movable indicator member. Whenever the reset tool is so positioned, wherein a recess contacts the flange, an operator may by gently pressing the housing member toward the electromagnetic indicator cause one of the shield members to move to the non-shielding position so that a selective one of the first or second resetting magnets is moved toward the magnetic member. During this movement, the gap between the permanent resetting magnet and the spherical magnetic indicator member will correspondingly diminish to the point that the magnetic indicator member will be repulsed by the magnetic field of the permanent resetting magnet.

Since the magnetic field of the resetting magnets is greater than that induced by the electromagnetic indicator, the corresponding magnetic repulsion will reverse the position of the spherical magnet indicator member. Inasmuch as the spherical indicator member is provided with different colors on the opposite sides thereof, such reversal of position will result in a change of color displayed by the indicator member. Consequently, a user of the portable reset tool may quickly and easily perform a reset operation. Furthermore, each of the electromagnetic indicators need not be provided with auxiliary permanent resetting magnets. Accordingly, for example, a less complex and costly instrumentation panel is furnished.

BRIEF DESCRIPTION OF THE DRAWINGS

These and other objects, features, and advantages of the present invention shall become readily apparent upon a detailed reading of a description of the preferred embodiment made in accordance with the principles of the present invention when viewed in conjunction with the accompanying drawings wherein like reference numerals indicate like structure throughout the several views and wherein.

DESCRIPTION OF A PREFERRED EMBODIMENT

Figure 1:
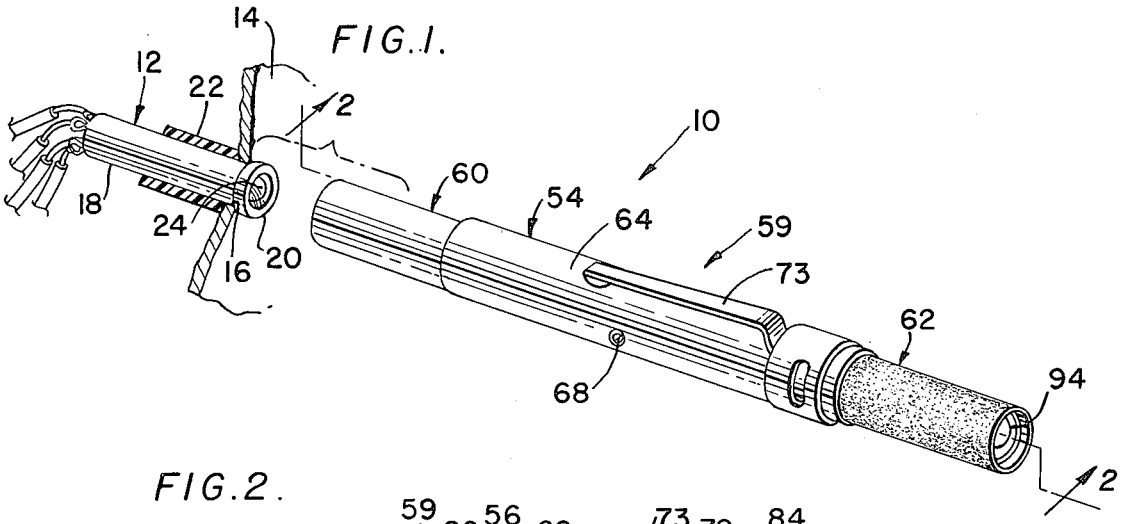
FIG. 1 is a perspective view of a portable magnet reset tool embodying the principles of the present invention shown prior to operative contact with a conventional electromagnetic indicator device.

Referring now to the drawings, there is shown a portable hand-gripable magnetic reset tool embodying the principles of the present invention and designated generally by reference numeral 10. Such reset tool 10 is particularly adapted for use in conjunction with a conventional type of electromagnetic indicator device which provides for non-illuminated contrasted color displays and which is generally indicated by reference numeral 12.

Figure 3:
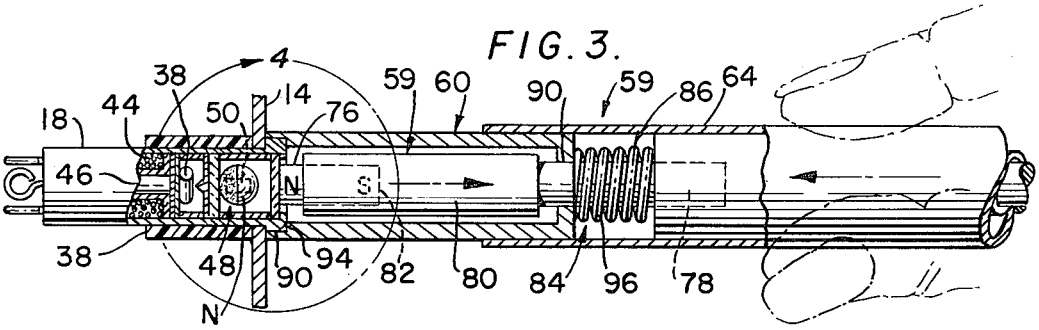
FIG. 3 is a somewhat enlarged side elevational view of the portable magnetic reset tool shown operatively associated with the electromagnetic indicator device prior to the spherical indicator member thereof being repositioned.
Figure 4:
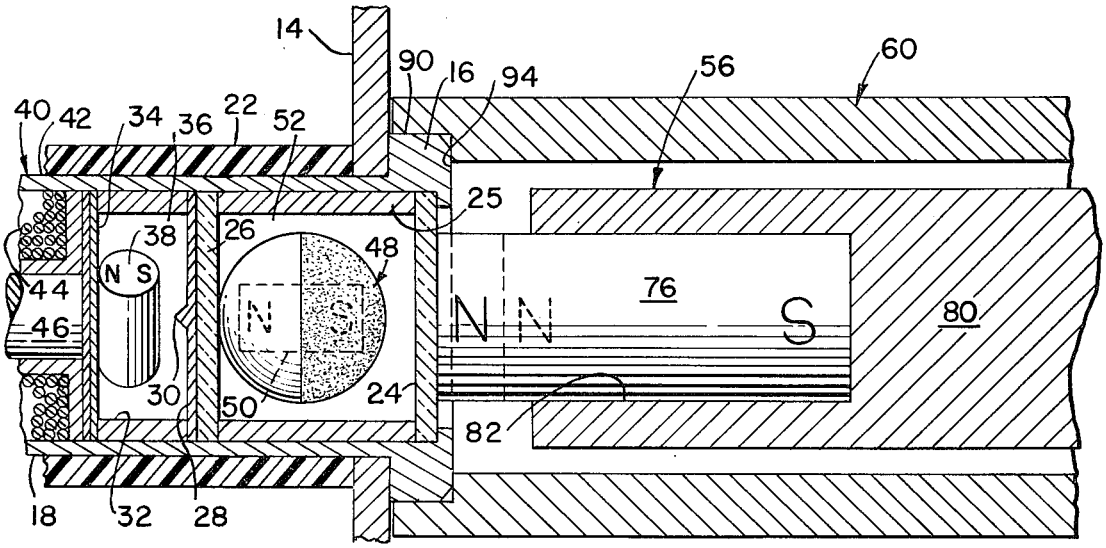
FIG. 4 is an enlarged view similar to that of FIG. 3 but showing the spherical indicator member after being repositioned by the reset tool of the present invention.

Particularly referring to FIGS. 1, 3 and 4, such electromagnetic indicator device 12 is arranged to be detachably secured to a suitable instrument panel 14 or the like. Panel 14 has formed therethrough an opening 16. Essentially, such electromagnetic indicator device 12 is of the type generally described in U.S. Pat. No. 2,425,055. Consequently, a detailed description of its construction and operation is not believed necessary for an understanding of the present invention. However, to better facilitate an understanding of the operation of the magnetic reset tool 10 of the instant invention a brief description of its structure and operation will be subsequently set forth in the succeeding description. The electromagnetic indicator device 12 includes a cylindrical casing 18 having formed at one end thereof an enlarged exterior flange 20. The casing 18 is inserted within hole 16 so that the enlarged flange 20 engages one side of the panel 14. Thereafter, a removable friction retaining sleeve 22 is slipped over the casing 18 and brought to bear against the rear side of the panel 14. Suitably formed and secured to the casing 18 is an appropriate type of transparent window pane 24 formed of plastic or glass. Disposed within the casing 18 is a sleeve 25 being formed of a material having a relatively low coefficient of friction. A first disc 26 abuts sleeve 25. A second disc 28 made out of a non-magnetic material has centrally formed thereon a conical dimple 30. The disc 28, a sleeve 32, and an uppermost disc 34 cooperate together to define a chamber 36 in which is disposed a permanent latching magnet 38 having a generally cylindrical shape. The latching magnet 38 normally serves to latch a magnetic indicator member in the indicated position. Located rearwardly of the uppermost disc 34 is a suitable electromagnet unit 40 which basically comprises a coil form 42 having a coil of insulated wire 44. Disposed in the coil form 42 is a magnetizable core 46.

Additionally, electromagnetic indicator device 12 further includes a ball or spherical movable magnetic indicator element 48 provided with binary indicia. In the illustrated embodiment, the binary indica may be comprised by each one-half surface of the ball 48 having a color different from the other half surface. Typically, one half may be red while the other half may be black so as to provide for maximum color contrast. Embedded within the ball 48 is a permanent bar magnet 50 having discrete or localized north and south magnetic poles as indicated in the drawings. Such spherical magnet member 48 could also be made of a moldable magnetic material which is magnetized across the diameter so as to provide for the noted localized poles. The spherical indicator member 48 is confined within a chamber 52 that is defined by the transparent pane 24, sleeve 25, and disc 26. The chamber 52 is so defined so as to permit ample freedom of movement for the spherical magnetic indicator member 48.

Referring to the permanent magnet 38 of the electromagnetic indicator device 12, as perhaps best shown in FIG. 3, it will be noted that the latching magnet 38 is polarized along its diameter. Essentially, the magnet 38 is sized so that it can rotate on its axis within the chamber 36 whenever contacting dimple 30. But, however, cannot flip over or tumble end to end and is arranged such that at least a portion thereof will always be located directly below the dimple 30. Normally, as observed above, magnet 38 latches the indicator member 48 in a particular position.

Briefly described, the electomagnetic indicator device 12 whenever energized creates, through the coil wire 44 and core 46, a magnetic field which, depending on its polarity, may reverse the position of the latching magnet 38. As latching magnet 38 has its position reversed, the indicator member 48 is similarly reversed through magnetic repulsion so that a corresponding one of its colors is displayed through window 24.

With reference to FIGS. 1–4 a preferred embodiment of a portable hand-gripable magnetic reset tool 10 made in accordance with the principles of the present invention is clearly depicted. This particular embodiment basically includes a generally elongated hand-gripable support means 54, first and second permanent resetting magnetic means 56 and 58, respectively, and shield means 59 including corresponding first and second slidable shield members 60 and 62, respectively.

Figure 2:
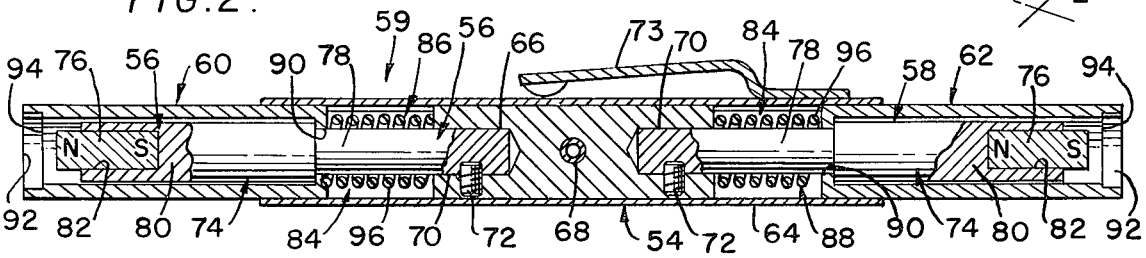
FIG. 2 is a sectional side elevational view taken substantially along section line 2—2 in FIG. 1 looking in the direction of the arrows and illustrating the portable magnetic reset tool in its operative state.

As perhaps best depicted in FIG. 3, the generally elongated portable support means 54 is adapted to be conventionally gripped by the fingers of an operator thereof. With reference now to FIG. 2, the support means 54 is depicted as including a generally tubular enclosure or support member 64 having, in a preferred embodiment, a generally cylindrical configuration. The support member 64 may be made of aluminum or some other suitable material. A main body support portion 66 is removably secured to and centrally disposed within the support member 64. A retaining pin 68 is arranged to slidably fit within openings (not shown) formed through the support member 64 as well as the main body support portion 66 so as to suitably interconnect the former to the latter. Formed at opposite ends of the main body portion 66 are bores 70. A pair of set screws 72 is threadedly connected to the main body portion 66 such that respective ones thereof cooperate with respective ones of the bores 70 for removably securing the first and second magnetic means 56 and 58, respectively, thereto in a known manner. To enable the magnetic reset tool 10 to be carried in a pocket of an operator, it has attached thereto in a well-known fashion, a spring clip 73.

In the preferred embodiment, both first and second magnetic means 56 and 58, respectively, include holding means 74 and permanent magnets 76. Each holding means 74 is defined by a generally elongated shank portion 78 which is slidably received within a bore 70 and also is adapted to threadedly cooperate with an appropriate set screw 72. Integrally connected to each shank portion 78 is a magnet holding portion 80 having a bore 82 which is appropriately dimensioned to snugly receive respective ones of the permanent magnets 76. Both permanent magnets 76 have discrete opposite magnetic poles and may be fabricated from a suitable magnetic material which is capable of inducing a magnetic field whose strength exceeds that applied by either the latching magnet 38 or the electromagnetic field of the core wire 44 and coil 46. By way of specific example, one such magnetic material which has proven satisfactory in use, especially whenever the magnetic reset tool 10 of the present invention cooperates with electromagnetic indicator 12 of the above-noted type, is ALNICO V which is a type charged, stabilized, and measured to a 1400 Gauss field strength per MINELCO PES. No. 7005. Of course, it is to be understood that other similar types of magnetic material may be provided so long as they function similarly.

Particularly referring to FIG. 2, it will be noted that the permanent resetting magnets 76 situated at the opposite ends of the reset tool 10 have opposite magnetic poles protruding axially outwardly therefrom. That is, one of the magnets 76 will have its north magnetic pole extending from the holding portion 80, whereas the other magnet 76 has the south magnetic pole protruding from its holding portion 80. Thus, for instance, if the north magnetic pole is placed in close proximity to the bar magnet 50 in the spherical indicator element 48 and such later magnet 50 has its north magnetic pole close to the window pane 24, ensuing magnetic repulsion results. Since, as previously mentioned, the magnetic field applied by the permanent magnet 76 is greater than that provided by the latching magnet 38 and indicator 12, the resulting magnetic repulsion is adequate to rotate the bar magnet 50 so that its opposite or south pole is attracted to the north magnetic pole of the permanent magnet 76. Accordingly, as the bar magnet 50 rotates to a different position, so does the spherical indicator member 48 connected thereto. Consequently, as the ball or spherical indicator member reverses its position, the opposite color associated with the opposite half of such indicator member 48 similarly reverses positions. Hence, a different color is outwardly visible through the window pane 24. It will also be noted that as the bar magnet 50 reverses position, the north pole thereof will be located opposite the north pole of indicator magnet 38. By virtue of the magnetic repulsion between such poles coupled with, of course, the fact that the field applied by the permanent magnets 76 exceeds that of the indicator or latching magnet 38, the latter will likewise reverse its position to the extent that its opposite or south pole is attracted to the north pole of the bar magnet 50 for purposes of latching the latter in its new position, whenever the reset tool 10 is removed. Hence, resetting of the electromagnetic indicator device 12 is easily accomplished. It will, of course, be understood that, if the south magnetic pole of the bar magnetic 50 had been outwardly oriented and the opposite permanent magnet 76 of the reset tool 10 were operated in conjunction therewith, the indicator member 48 would, as believed apparent from the foregoing, likewise reverse its position to thereby provide a different color which would correspondingly be displayed through the pane 24.

With continued reference to FIGS. 2 to 4, there will be more fully depicted the shield means 59 and biasing means 84 of the preferred embodiment. As best shown in FIG. 2, there is depicted the first and second shield members 60 and 62, respectively. The shield members 60 and 62 are arranged such that they substantially enclose the magnetic means 56 and 58, respectively. In addition, they are movable between first or shielding positions (see FIG. 2) and a second or nonshielding positions (see FIGS. 3 and 4). Whenever in the second positions, the magnetic flux of the resetting magnets 76 is sufficient to actuate the indicator member 48 in a manner more fully described. This is by virtue of the fact that the resetting magnets 76 are located in closer proximity to the indicator member 48. Moreover, since the shield members 60 and 62 circumferentially surround the resetting magnets 76 even when in the second position there is a reduced likelihood that other indicator members 48 on panel 14 will be inadvertently actuated.

Biasing means 84 are provided which include respective first and second resilient means 86 and 88 for the respective first and second shield members 60 and 62. Inasmuch as the first and second shield members 60 and 62 and resilient means 86 and 88 are of identical construction and operation only one of the shield members 60 and reslient means 86 will be subsequently discussed. The shield member 60 has a generally elongated configuration. One end of member 60 has an opening 90 centrally formed therein for enabling sliding movement of the member 60 with respect to the shank member 78. The open end of the shield member 60 has an annular recess 92 formed to define an abutment ledge 94. The ledge 94 is more clearly illustrated in FIGS. 3 and 4 and as shown therein is arranged to cooperate with the outward enlarged annular flange 20 formed on casing 18 of electromagnetic indicator 12. The shield member 60 itself may be manufactured from a suitable material for shielding the magnetic field emanating from the permanent magnet 76. One such suitable material may be an electromagnetic iron which primarily serves to prevent leakage of the magnetic flux. Another purpose served by the shield member 60 is that the flux will be better concentrated toward the front or open end of the shield member. It is within the spirit and scope of the present invention that other similar and suitable materials may be used to fabricate the shield members 60. The resilient means 86 may be basically comprised of a single metallic coil spring 96 which may be made of steel. The spring 96 is disposed about the shank portion 78 and is supported between the shield member 60 and an end of the main body portion 66. In this particular arrangement, coil spring 96 will normally act to bias the shield member 60 outwardly.

As more precisely denoted in FIGS. 3 and 4, the ledge 94 is arranged to cooperate with the enlarged annular flange 20 of indicator device 12 to thereby facilitate the resetting of the indicator member 48. Whenever the shield member 60 is so positioned, as above indicated, an operator in order to reset or change the color displayed by the indicator element 48 merely forces the support member 64 and thereby an appropriate one of the permanent magnets 76 toward the electromagnetic indicator device 12, such as shown in FIG. 3. As a consequence of this particular action, the spring 96 will be compressed as a result of the shield member 60 moving from its shielding or first position to its non-shielding or second position, and the permanent magnet 76 is moved into closer proximity to the indicator member 48. By reason of the fact that the shield member 60 slides inwardly with respect to the support member 64, the amount of shielding at the front end of the shield member is diminished. Although FIGS. 3 and 4 illustrate that the permanent magnet 76 contacts the window pane 24, such contact or engagement is not necessary for effecting reversal of the indicator element 48. In fact, it is contemplated that the permanent magnets 76 may also be properly operable to effect repositioning of indicator member 48 should they be situated so that a space or gap exists between the end of the magnets 76 and the window pane 24, as indicated by the phantom lines in FIG. 4. It should also be mentioned that the distance of the gap will be dependent upon the comparative strengths of the magnets and that of the ball magnet 50. It will, of course, be understod that, upon withdrawal of the reset tool 10 from the flange 20, coil spring 96 will once again cause the shield member 60 to move out from the support member 64 and reassume its shielding or extended position as depicted in FIG. 2. In this position, since the shield member 60 is fully extended, it will be appreciated that the shielding afforded thereby acts to prevent the permanent magnet 76 from inadvertently actuating other indicator devices (not shown) which may be closely, as is normally the case, clustered together on the instrument panel 14. Also, the distance the shield member 60 moves from the shielding position to the non-shielding position should be sufficient to enable the magnetic field of the resetting magnet 76 to appropriately actuate the indicator member 48 whenever in the resetting position as previously described.

In light of the foregoing description concerning the constructional arrangement of the portable magnetic reset tool 10 of the instant embodiment, its operation is believed to be readily apparent. While the reset tool 10 has been described for use in conjunction with the resetting of a spherical indicator 48 in binary electromagnetic indicators 12, it is well within the dicta and theory of the present invention that the reset tool 10 could be used to magnetically actuate other devices without departing from the principles thereof.

In applicants' constructional arrangement, by using a portable magnetic reset tool, the need for additional resetting magnets associated with each electromagnet indicator is not required. In addition, the manual reset tool has a relatively simply structure and functions in a highly reliable manner.

While the instant invention has been described in connection with a preferred embodiment, it is not intended to limit the invention to the particular form set forth, but, on the contrary, it is intended to cover such alternatives, modifications, and equivalents as may be included within the spirit and scope of the invention as defined by the appended claims.

What is claimed is:

1. A portable magnetic tool device adapted for adjusting the position of a movable magnetic member or the like comprising a portable support means, at least a first magnetic means connected to said portable support means having a first magnetic field which enables selective adjusting of the position of the movable member, and shield means operatively connected to said portable support means and at least partially surrounding and shielding said first magnetic means for movement between first and second positions, such that whenever in the second position said first magnetic field is able to appropriately adjust the position of the movable magnetic member, and a second magnetic means connected to said support means and having a second magnetic field which is opposite to the first magnetic field for repositioning of the movable magnetic member.

2. A portable tool adapted for repositioning a movable magnetic member having opposite north and south poles comprising a portable support means, first and second magnetic means attached to said support means, said first magnetic means has one of either the opposite north or south magnetic poles directed outwardly from said support means, said second magnetic means having the magnetic pole opposite to the first magnetic means directed outwardly from said support means, said first and second magnetic means adapted for selectively repositioning the movable member, and shield means connected to said support means for respectively surrounding and shielding said first and second magnetic means, said shield means movable between first and second positions such that whenever in the first position said first magnetic means cannot actuate the movable member and whenever in the second position enables said first magnetic means to actuate the movable member while still surrounding said first magnetic means.

3. A portable tool as set forth in claim 2 in which said shield means includes first and second shield members having an open end and being slidably movable with respect to said support means and said first and second magnetic means, such that whenever said first and second shield members are moved to said second position said first and second magnetic means are moved closer towards said open end of said first and second shield members.

4. A portable tool as set forth in claim 3 which further comprises biasing means for biasing each of said first and second shield members outwardly with respect to said support means to said first position and being connected between said support means and respective ones of said first and second shield members.

5. A portable tool device as set forth in claim 4 in which said biasing means includes first and second resilient means each of which respectively cooperate with said first and second shield members.

6. A hand portable magnetic reset tool adapted for externally resetting electromagnetic indicators or the like which have a housing with an end flange, a movable magnetic indicator element movable within the housing for indicating the conditions of the electromagnetic indicator and being subjected to opposite magnetic fields of the electromagnetic indicator comprising a generally elongated portable hand gripable support means, first and second permanent magnet members respectively secured adjacent opposite ends of said support means, said first magnetic member having a north magnetic pole facing away from said support means with said magnetic north pole having a field exceeding that of the magnetic fields applied by the electromagnetic indicator on the movable indicator member for repositioning the movable indicator element, said second magnetic member having a south magnetic pole facing away from said support means with a magnetic field exceeding that of the magnetic fields applied by the electromagnetic indicator for repositioning the movable indicator element, and first and second spring biased generally elongated shield members slidably connected to the opposite ends of said support means for respectively shielding said first and second magnet member, each of said first and second shield members having a recess formed adjacent an open end thereof and being adapted to receive the end flange of the electromagnetic indicator for enabling the positioning of said reset tool on the end flange such that whenever either of said recesses contact the end flange of the housing member, and said support means is forced toward the electromagnetic indicator for respectively effectuating relative movement of either said first and second magnet members toward said open ends of said first and second shield members, said first and second magnet members are respectively moved into close proximity to the magnetic movable element to thereby enable repositioning of the magnetic movable element.

* * * * *